United States Patent [19]

Woods

[11] Patent Number: 4,561,563

[45] Date of Patent: Dec. 31, 1985

[54] INSULATED COOLER FOR BEVERAGE CONTAINERS

[76] Inventor: David E. Woods, 2647 Kodiak Ct., Houston, Tex. 77067

[21] Appl. No.: 639,455

[22] Filed: Aug. 10, 1984

[51] Int. Cl.[4] ..... B65D 25/34; B65D 43/18; B65D 47/08; B65D 47/20

[52] U.S. Cl. ..... 220/412; 220/90.4; 220/264; 220/336; 220/411; 222/516

[58] Field of Search ..... 220/90.2, 90.4, 90.6, 220/408, 410, 411, 412, 413, 331, 263, 264; 215/13 R; 222/129.1, 131, 505, 557, 516, 517, 556

[56] References Cited

U.S. PATENT DOCUMENTS

| | | | |
|---|---|---|---|
| 1,041,971 | 10/1912 | Day | 222/131 |
| 1,935,969 | 11/1933 | Witherspoon | 222/131 |
| 2,167,866 | 8/1939 | Bennett | 222/131 X |
| 2,187,927 | 1/1940 | Ayotte | 222/517 X |
| 2,197,763 | 4/1940 | Kahn | 222/131 X |
| 2,578,201 | 12/1951 | Nicorvo | 220/90.4 X |
| 3,120,319 | 2/1964 | Buddrus | 215/13 R |
| 3,482,801 | 12/1969 | Leontas | 220/331 X |
| 3,905,511 | 9/1975 | Groendal | 220/90.2 |

*Primary Examiner*—Allan N. Shoap
*Attorney, Agent, or Firm*—Neal J. Mosely

[57] ABSTRACT

An insulated enclosure for beverage containers comprises upper and lower cup shaped cylindrical members each having a durable plastic outer casing and an inner lining of thermal insulating material receive and substantially enclose said beverage container. An opening in the upper member exposes a portion of the beverage container adjacent its opening. A pair of pivot members mounted on the upper member are operated by a level disposed on the sidewall to selectively expose the opening of the beverage container.

16 Claims, 5 Drawing Figures

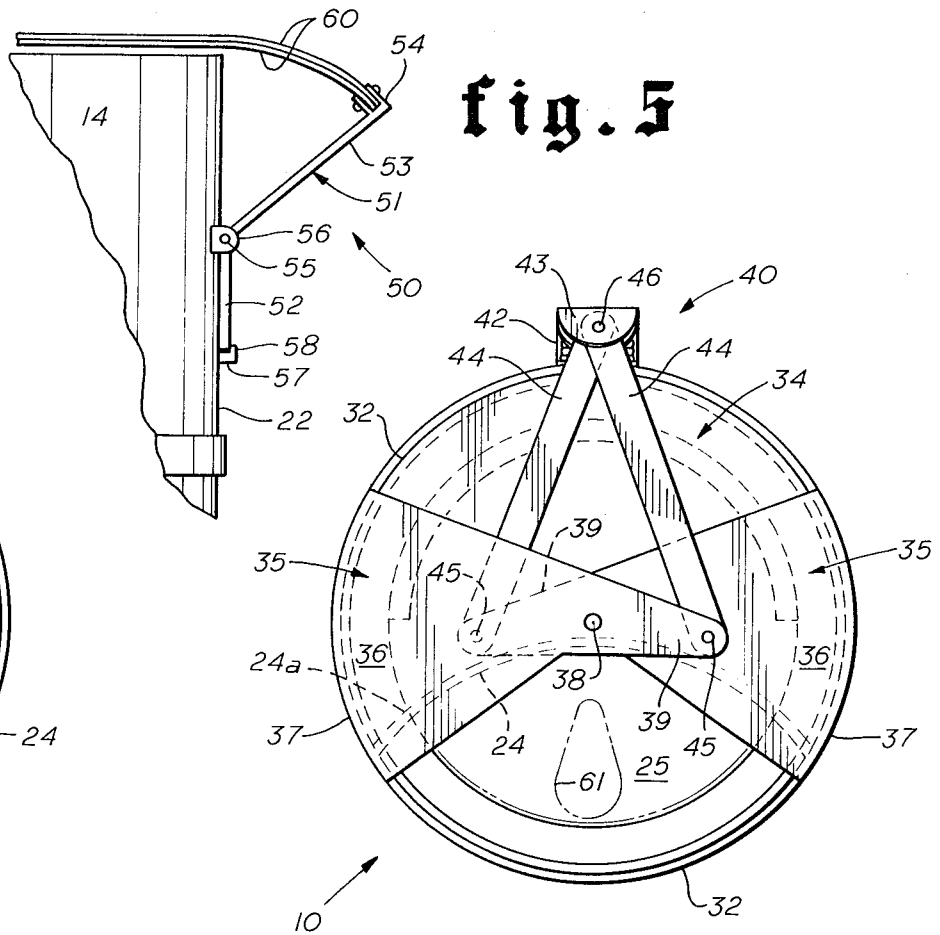
fig. 5
fig. 4
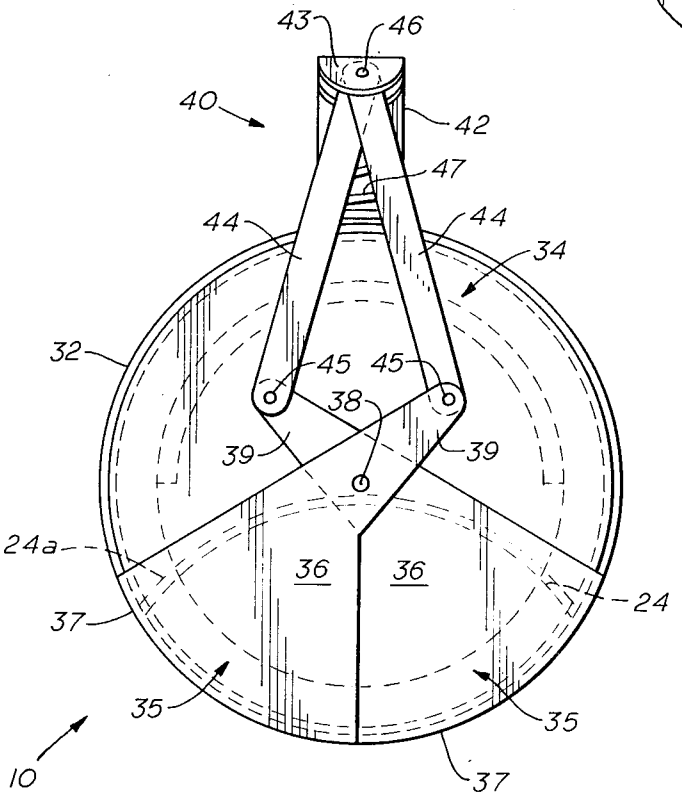
fig. 3

INSULATED COOLER FOR BEVERAGE CONTAINERS

BACKGROUND OF THE INVENTION

1. Field of the Invention

This invention relates to hand-held insulated enclosures for beverage containers, and more particularly to a hand-held insulated enclosure for beverage containers having pivotal closure means to selectively expose the opening of said container.

2. Brief Description of the Prior Art

Insulated enclosures or coolers for beverage cans and devices having closures are known in the art. One common type of cooler consists merely of a cylindrical cup shaped can holder formed of polyurethane material. Another common insulating enclosure having a closure means is a plastic "travel cup" for beverages which has a lid containing an opening which is normally closed by a plug and is uncovered by pressing a plastic button disposed on the sidewall of the container. There are several patents which disclose various coolers and closures.

Goulding, U.S. Pat. No. 414,699 discloses a cover for ink bottles with a scissors type closure comprising a lever pivoted on a horizontal pivot during the dipping of an ink pen into a bottle of ink to laterally separate a pair of cover plates which are normally held closed by a spring joining them together.

Widener, U.S. Pat. No. 3,155,260 discloses a heat control device designed for warming a baby bottle. The device comprises a a pair of opposing cup shaped cylindrical members of thermally insulating material which when joined together form an air tight enclosure. The walls of the enclosure are spaced from the bottle and the space therebetween is filled with hot water to raise the temperature of the liquid in the bottle.

Vevirit et al, U.S. Pat. No. 3,481,506 discloses an ashtray employing a pair of laterally pivoting or scissors type closure plates. An actuating arm for the plates is mounted for rocking movement on the ashtray cover and is provided with a laterally projecting lower end to underlie and protect the pivot connection of the closure plates. An intermediate portion of the actuating arm carries a C-shaped link connected to the closure plates.

Brownson, U.S. Pat. No. 1,152,286 discloses a garbage can cover which fits onto a concrete case and supports a pail. The cover is provided with a circular opening and a pair of ears which receive a lid which may be swung upwardly and rearwardly. The lid comprises a pair of closures mounted on a pair of intermeshed gears which form pivot elements to separate the closures which are normally held closed by a spring joining them together. The closures are separated by pushing together two rearwardly projecting extension portions. In order to facilitate movement of the closures, a track containing ball bearings is disposed on the cover underneath the closures.

Bretney, U.S. Pat. No. 2,552,397 discloses a lid and operating mechanism therefor which may be attached to drinking glasses and the like. The device comprises a lid support having an inverted hook at its upper end to receive the lip of a tumbler and a C-shaped clamp member at its lower end to grip the tumbler. A lid is rotatably mounted at the top of the support and the lower end of a lever having its upper end free to move is connected to the support. The lid has an arm projecting radially outward from the point of rotation which is provided with a cam slot disposed at an angle to the line of motion of the free end of the lever. The free end of the lever has a projection which fits into the slot whereby on flexing of the lever the lid may be turned to cover and uncover the tumbler.

The prior art in general, and none of these patents in particular, disclose the present insulated enclosure and scissors type closure combination.

SUMMARY OF THE INVENTION

It is therefore an object of the present invention to provide a hand-held insulated enclosure for beverage containers which will maintain the contents at a relatively constant temperature while being consumed.

Another object of this invention is to provide an insulated enclosure for beverage containers having a closure means which will allow the container to be enclosed except when drinking therefrom.

Another object of this invention is to provide an insulated enclosure for beverage containers which is adaptable to receive and enclose beverage containers of various size.

Another object of this invention is to provide an insulated enclosure having a durable outer casing and a thermal insulating inner lining.

Another object of this invention is to provide an insulated enclosure for beverage containers which is simple in construction and inexpensive to manufacture.

Other objects of the invention will become apparent from time to time throughout the specification and claims as hereinafter related.

The above noted objects and other objects of the invention are accomplished by the present insulated enclosure for beverage containers comprising upper and lower cup shaped cylindrical members each having a durable plastic outer casing and an inner lining of thermal insulating material which receive and substantially enclose said beverage container, an opening in the upper member exposing a portion of the beverage container adjacent its opening, and a pair of pivot members mounted on the upper member which are operated by a lever disposed on the sidewall to selectively expose the opening of the beverage container.

BRIEF DESCRIPTION OF THE DRAWINGS

FIG. 3 is a top plan view of the insulated cooler of FIG. 1 showing the lid closure in the closed position.

FIG. 4 is a top plan view of the insulated cooler of FIG. 1 showing the the closure in the opened position.

FIG. 5 is a side-elevation, detail view of an alternate lid closure mechanism.

DESCRIPTION OF THE PREFERRED EMBODIMENT

Figure 2:
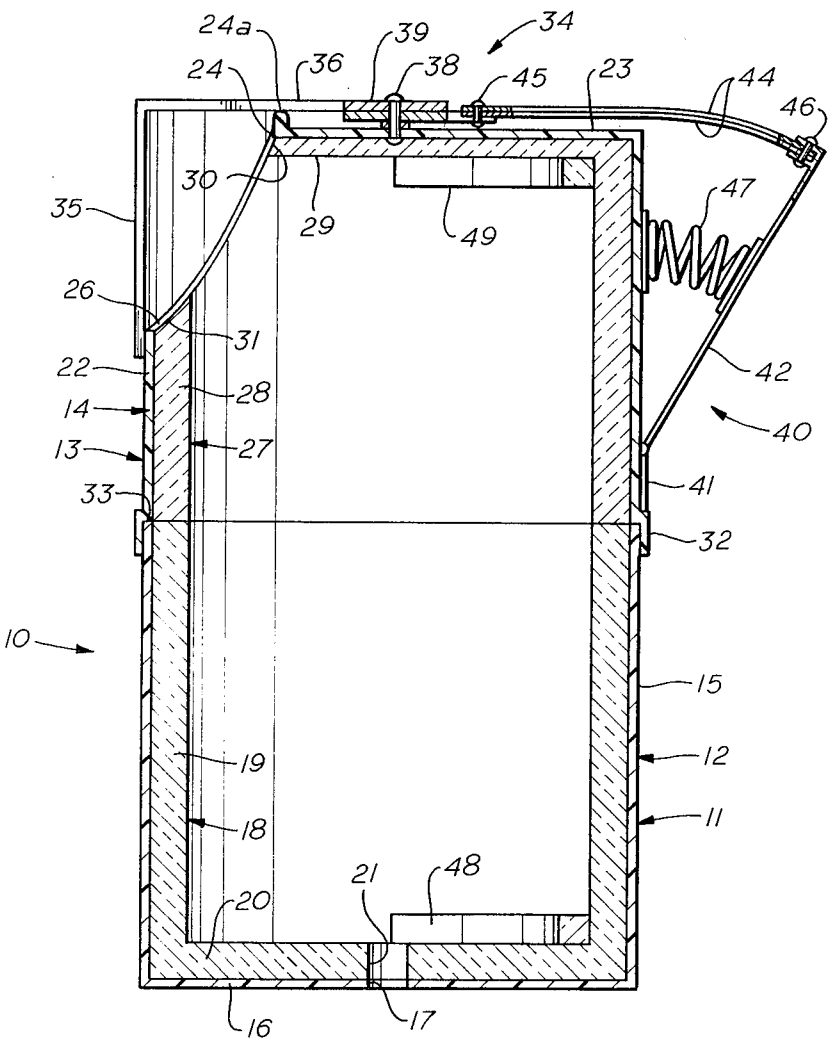
FIG. 2 is sectional view of the insulated cooler for beverage cans taken along line 2—2 of FIG. 1.
Figure 1:
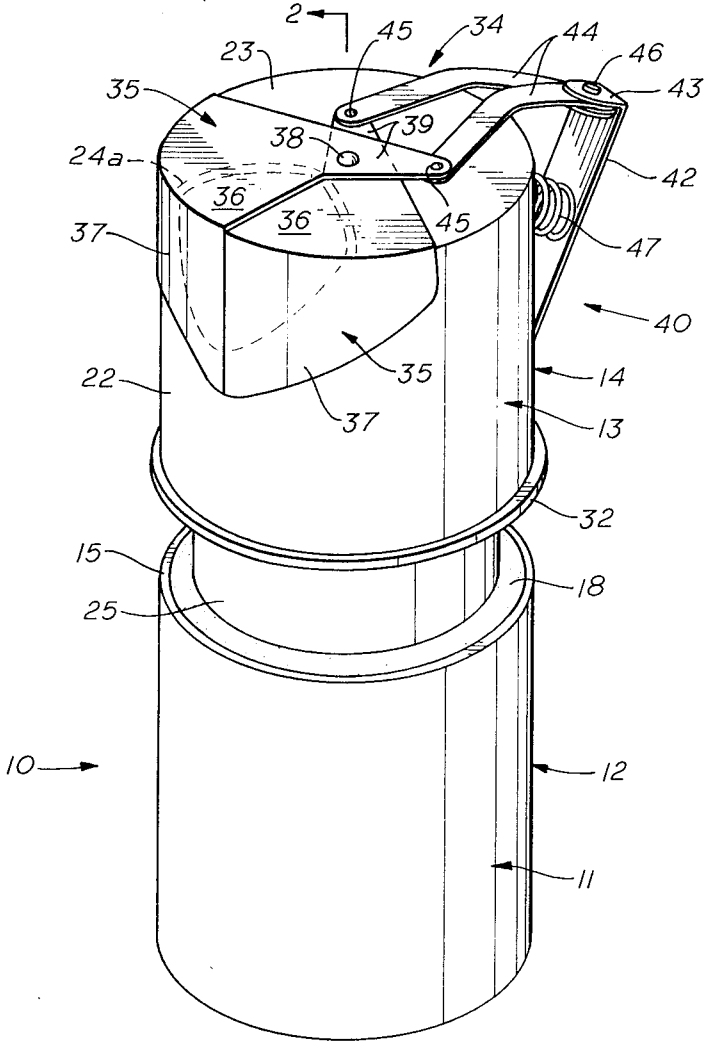
FIG. 1 is an isometric view of an insulated cooler for beverage cans in accordance with the present invention.

Referring to the drawings by numerals of reference, there is shown a preferred embodiment of an insulated cooler 10 for beverage cans. Cooler 10 comprises a lower cup-shaped cylindrical member 11 having an outer casing 12 and an upper inverted cup-shaped cylindrical member 13 having an outer casing 14. The outer casings 12 and 14 are formed of durable plastic material such as polyethylene.

The lower outer casing 14 has a cylindrical side wall 15 and a planar bottom wall 16 which has a central aperture 17 therein for fluid drainage and to allow air to escape for easy insertion and removal of beverage cans. A cylindrical cup-shaped inner lining 18 having a cylindrical side wall 19 and a bottom wall 20 lines the inner surfaces of the outer casing 12. The bottom wall 20 is provided with an aperture 21 in axial alignment with the aperture 17. The lining 18 is formed of thermal insulating material such as polyurethane foam or expanded polystyrene, and may be molded into the casing or secured therein by a conventional bonding agent.

The upper casing 14 comprises a cylindrical side wall 22 and a planar top wall 23. The top wall 23 has a horizontal arcuate opening 24, with a bead **24*a*, curved inwardly from the outer circumference to expose a portion of the top surface of a beverage can 25. The side wall 22 is provided with a circumferentially disposed vertical arcuate opening 26 which adjoins the horizontal opening 24 and extends downwardly therefrom to expose a portion of the side of the beverage can 25. Openings 24 and 26 cooperate to form a single opening which exposes a portion of the side and top of the beverage can 25** permitting access thereto for drinking.

A cylindrical cup-shaped inner lining 27 having a cylindrical side wall 28 and a top wall 29 lines the upper casing 14. Lining 27 has top and side openings 30 and 31 aligned with the openings 24 and 26 in the upper casing 14. The lining 27 is formed of thermal insulating material such as polyurethane foam or expanded polystyrene, and may be molded into the casing or secured therein by a conventional bonding agent. A circumferential depending lip or flange 32 extends radially outward and longitudinally from the bottom of the side wall 22 of the upper casing 14 to define a shoulder 33 therebetween. The inner diameter of the lip or flange 32 is not lined and is sized to slidably receive the top portion of the side wall 15 of the lower casing 12.

A lid closure assembly 34 is attached to the top surface of the upper casing 14 and covers the openings 24 and 26. The closure assembly 34 comprises a pair of pivot members 35 each having a generally pie shaped or semi-arcuate horizontal top portion 36 and a circumferential vertically-extending semi-arcuate skirt portion 37. The top portions 36 of the pivot members 35 are overlapped and mounted on the top wall 23 of the upper casing 14 by a pivot pin or rivet 38 which extends through an aperture in the top wall 23 and apertures in the members 35 to commonly join them in a scissors relationship. When assembled, the lateral surfaces of the top portions 36 and skirt portions 37 conform to, and extend slightly beyond, the periphery of openings 24 and 26.

The top portions 36 of the pivot members 35 are provided with flat rearwardly protruding, diverging extensions or ears 39. A flat rectangular lever member 40 is supported on the side wall 22 of the upper casing 14. Lever member 40 is of molded plastic having a hinged bottom portion 41, a straight intermediate portion 42, and a laterally projecting top portion in the form of a pivot yoke 43. The lever 40 is secured at its hinged bottom portion 41 to the side wall 22 by a suitable bonding agent.

A pair of thin flat straps 44 of resilient plastic material having apertures in opposing ends are each pivotally connected at one of their ends to one of the ears 39 by a pivot pin or rivet 45. The straps 44 extend from the ears 39 rearwardly beyond the circumference of the upper casing 14. The extended ends of the straps 44 are overlapped and pivotally joined into the yoke 43 of the lever 40 by a pivot pin or rivet 46 extended therethrough. In this manner, the intermediate portion 42 of the lever 40 extends angularly upward and outward from the side wall 22 and the straps 44 are slightly curved downward to the yoke 43. A compression spring 47 positioned between the side wall 22 and the intermediate portion 42 of the lever 40 biases the lever outward to retain the pivot members 35 in the closed position.

A semi-annular lower adapter ring 48 may be removably placed into the lower member 11 to reside against the bottom 20 and side wall 19 of the lining 18, and a similar upper adapter ring 49 into the upper member 12 against the top wall 29 and side wall 28 to adapt the cooler 10 to various beverage container sizes. A container of smaller diameter would fit within the interior of the adapters 48 and 49, a taller container would extend vertically inside the adapters, and the ends of a shorter container would rest on the upper and lower surfaces of the adapters.

FIG. 5 illustrates an alternate closure mechanism 50 which does not require a compression spring. A flat rectangular lever member 51 of molded plastic is positioned on the side wall 22 of the upper casing 14. Lever member 51 has a hinged bottom portion 52, a straight intermediate portion 53, and a laterally projecting top portion in the form of a yoke 54. A small bead 55 extends laterally from each side of the hinged bottom portion to be snapped into a pair of apertured ears 56 which extend outwardly from the side wall 22. A small bracket 57 extends outwardly from the side wall 22 and is provided with a small upwardly extending lip 58. The bottom of the hinged portion 52 of the lever 51 is placed into the bracket 57 and the beads 55 are snapped into the ears 56.

A pair of thin flat straps 60 of resilient plastic material having apertures in opposing ends are each connected to the ears 39 and to the yoke 54 as previously described. In this embodiment, the intermediate portion 53 of the lever 51 extends angularly upward and outward from the side wall 22 and the straps 60 are curved sufficiently downward to the yoke 54 whereby the curvature of the resilient plastic straps 60 creates an expansion force to bias the intermediate portion 53 of the lever 51 outward from the side wall 22 and retain the pivot members 35 in the closed position.

OPERATION

With the upper and lower members 11 and 12 separated, a beverage can 25 is placed into the bottom member 11. The upper member 12 is placed over the can 25 with the pivot members 35 aligned with the opening 61 in the top of the can 25. The upper member 12 is then pressed down until shoulder 33 of the lip 32 rests on the top of the side wall 15 of the lower casing 12. To expose the opening 61 of the can 25, the intermediate portion 42 of the lever 40 is pressed inwardly by the index finger of the user causing the straps 44 to move forward and pivotally separate the members 35 laterally until the opening 61 of the can 25 is exposed and the user can drink therefrom. To cover the opening 61, pressure is removed from the intermediate portion 42 of the lever 40, allowing the spring 47 to push the lever outward causing the straps to move rearward and pivotally close the pivot members 35 over the opening 61. The bead 24a around opening 24 provide a protective seal within the underside of lid members 35.

While this invention has been described fully and completely with special emphasis upon a preferred embodiment, it should be understood that within the scope of the appended claims the invention may be practiced otherwise than is specifically described herein.

I claim:

1. An insulated enclosure for containers comprising in combination:

an insulated upper cup-shaped cylindrical member adapted to receive and partially enclose a container of a consumable product and having a continuous top and side opening operable to be located over a top opening in said consumable product container, an insulated lower cup-shaped cylindrical member adapted to receive and partially enclose a container containing a consumable product, and fitting said upper member to form a complete enclosure around said container, closure means mounted on said upper member in position to open and close said opening therein and operable by the user of said enclosure to selectively expose said container opening, and said upper member opening being of a size and shape when open to expose a portion of the top and side surfaces adjacent said opening of said container sufficient to allow the user to directly consume the contents therefrom.

2. An insulated enclosure for beverage containers comprising in combination:

an insulated upper cup-shaped cylindrical member adapted to receive and partially enclose a beverage container and having a continuous top and side opening operable to be located over a top opening in said beverage can, an insulated lower cup-shaped cylindrical member adapted to receive and partially enclose a beverage container, and fitting said upper member to form a complete enclosure around said beverage container, closure means mounted on said upper member in position to open and close said opening therein and operable by the user of said enclosure to selectively expose said beverage container opening, and said upper member being of a size and shape when open to expose a portion of the top and side surfaces ad jacent said opening of said beverage container sufficient to allow the user to drink therefrom.

3. The enclsoure according to claim 2 in which said lower cup-shaped cylindrical member comprises:

an outer casing having a cylindrical side wall and a planar bottom wall with a central aperture therein, a cylindrical cup-shaped inner lining on the inner surfaces of said casing having a cylindrical side wall and a bottom wall having an aperture axially aligned with said casing central aperture, and in which said upper, cup-shaped, cylindrical member comprises;

an outer casing having a cylindrical side wall and a planar top wall with a horizontal arcuate opening therein curved inwardly from the outer circumference of said top wall to expose a portion of the top surface of said beverage container, said side wall provided with a circumferentially positioned vertical arcuate opening adjoining said top horizontal opening and extending downwardly therefrom to form a single opening operable to expose a portion of the side of said beverage container, a cylindrical cup-shaped inner lining on the inner surfaces of said upper casing having a cylindrical side wall and a top wall having openings conforming to the openings of said outer casing, and said inner linings of said casings formed of thermal insulating material.

4. The enclosure according to claim 3 in which said upper casing has a circumferential depending lip extending radially outward and downward from the bottom of said side wall adapted to slidably receive the top portion of said lower casing.

5. The enclosure according to claim 3 further including:

a removable semi-annular lower adapter member insertable into said lower member against the bottom and side wall of said lining, and a removable semi-annular upper adapter member insertable into said upper member against the top wall and side wall of said lining, said adapters being operable to adapt said enclosure to various beverage container sizes.

6. The enclosure according to claim 1 in which said closure means comprises:

a pair of closure members pivotally supported on said upper member top wall in a scissors relationship and operable when closed to close said top opening and when open to expose said opening, and means supported on said upper member side wall connected to said closure members for moving the same to open and to closed positions.

7. The enclosure according to claim 6 in which said closure member moving means includes means biasing the same towards closed position.

8. The enclosure according to claim 6 in which said closure member moving means includes lever means connected to said closure members to positively move the same between closed position and open position.

9. The enclosure according to claim 6 in which said top opening is partly in the top and partly in the side wall of said upper cup-shaped member, and said pair of closure members each having a cylindrical portion fitting said upper member side wall and an end wall portion at a right dihedral angle thereto fitting said upper member top wall and pivotally supported on said upper member top wall in a scissors relationship and operable when closed to close said top opening and when open to expose said opening.

10. The enclosure according to claim 9 in which said closure means comprises:

a pair of pivot members each having a generally pie shaped or semi-arcuate horizontal top portion and a circumferential vertically depending semi-arcuate skirt portion, said top portions overlapped and pivotally mounted on the top surface of said upper member and provided with rearwardly protruding, diverging extensions, a lever member having a hinged bottom portion, a straight intermediate portion, and a laterally projecting top portion in the form of a yoke, said lever member secured to the side wall of said upper member at its hinged bottom portion and said intermediate portion extending upward and outward therefrom, and a pair of thin flat straps of resilient material having apertures in opposing ends each said strap pivotally connected at one end to one of said extensions, said straps extending from said extensions rearwardly beyond the circumference of said upper member, the rearwardly extending ends of said straps overlapped, curved downward, and pivotally joined into said yoke of said lever.

11. The enclosure according to claim 10 further including:

a compression spring between the side wall of said upper member and said intermediate portion of said lever to bias the same outward to apply a tension force on said straps and thereby urge said pivot members to the closed position.

12. The enclosure according to claim 6 in which said top opening is partly in the top and partly in the side wall of said upper cup-shaped member, and said pair of closure members each having a cylindrical portion fitting said upper member side wall and an end wall portion at a right dihedral angle thereto fitting said upper member top wall and pivotally supported on said upper member top wall in a scissors relationship and operable when closed to close said top opening and when open to expose said opening.

13. The enclosure according to claim 1 in which said closure means comprises:

a pair of closure members pivotally supported on said upper member top wall in a scissors relationship and operable when closed to close said top opening and when open to expose said opening, and means supported on said upper member side wall connected to said closure members for moving the same to open and to closed positions.

14. The enclosure according to claim 1 in which said lower cup-shaped cylindrical member comprises:

an outer casing having a cylindrical side wall and a planar bottom wall with a central aperture therein, a cylindrical cup-shaped inner lining on the inner surfaces of said casing having a cylindrical side wall and a bottom wall having an aperture axially aligned with said casing central aperture, and in which said upper, cup-shaped, cylindrical member comprises:

an outer casing having a cylindrical side wall and a planar top wall with a horizontal arcuate opening therein curved inwardly from the outer circumference of said top wall to expose a portion of the top surface of said beverage container, said side wall provided with a circumferentially positioned vertical arcuate opening adjoining said top horizontal opening and extending downwardly therefrom to form a single opening operable to expose a portion of the side of said beverage container, a cylindrical cup-shaped inner lining on the inner surfaces of said upper casing having a cylindrical side wall and a top wall having openings conforming to the openings of said outer casing, said inner linings of said casings formed of thermal insulating material, said closure means comprises:

a pair of closure members pivotally supported on said upper member top wall in a scissors relationship and operable when closed to close said top opening and when open to expose said opening, and means supported on said upper member side wall connected to said closure members for moving the same to open and to closed positions.

15. The enclosure according to claim 14 in which said closure member moving means includes means biasing the same towards closed position.

16. The enclosure according to claim 14 in which said closure member moving means includes lever means connected to said closure members to positively move the same between closed position and open position.

* * * * *